US007007725B2

(12) United States Patent
Peltier

(10) Patent No.: US 7,007,725 B2
(45) Date of Patent: Mar. 7, 2006

(54) SYSTEM FOR SANITARY WATER FILLING AND DISPENSING

(75) Inventor: Shaun Peltier, 8054 Enclave Cir., Woodbury, MN (US) 55125

(73) Assignee: Shaun Peltier, Woodbury, MN (US)

( * ) Notice: Subject to any disclaimer, the term of this patent is extended or adjusted under 35 U.S.C. 154(b) by 30 days.

(21) Appl. No.: 10/646,469

(22) Filed: Aug. 21, 2003

(65) Prior Publication Data

US 2005/0039819 A1 Feb. 24, 2005

(51) Int. Cl.
*B65B 1/04* (2006.01)

(52) U.S. Cl. ..... 141/316; 141/10; 141/114; 141/314

(58) Field of Classification Search ..... 141/2, 141/10, 114, 313–316; 53/167, 389, 426; 222/95–107
See application file for complete search history.

(56) References Cited

U.S. PATENT DOCUMENTS 3,112,047 A * 11/1963 Weinreich et al. ..... 222/105
3,638,834 A * 2/1972 Goodrich et al. ..... 222/105
4,120,134 A * 10/1978 Scholle ..... 53/434
4,417,607 A * 11/1983 Scholle et al. ..... 141/1
4,452,030 A * 6/1984 Inada ..... 53/426
4,516,693 A * 5/1985 Gaston ..... 222/105
4,867,208 A * 9/1989 Fitzgerald et al. ..... 141/18
6,245,228 B1 * 6/2001 Kelada ..... 210/206

* cited by examiner

*Primary Examiner*—Timothy L. Maust
(74) *Attorney, Agent, or Firm*—Schwegman, Lundberg, Woessner & Kluth, P.A.

(57) ABSTRACT

A sanitary bag having an outlet tube, the bag adapted to be sanitarily filled with water by an end-user of the bag, and an insulated container to hold the bag in a location remote from a water-filling location, the container including a spigot, wherein the outlet tube of the bag extends through the spigot. A method including attaching an input member from a sanitary water supply to an inlet of a bag in a substantially sealed configuration, filling the flexible bag with water, removing the input member from the inlet without allowing any contaminants to reach the water, and placing the flexible bag within a portable insulated container for use at a location remote from the filling location.

14 Claims, 6 Drawing Sheets

SYSTEM FOR SANITARY WATER FILLING AND DISPENSING

FIELD

This invention relates to the field of beverage dispensing, and more specifically to a system and method for sanitary water dispensing.

BACKGROUND

Water dispensing on a golf course, or other remote point-of-use location, is typically accomplished by filling a 10 gallon jug cooler with water at the clubhouse, for example. The cooler is brought to its point-of-use location, where users then fill cups from a spigot on the cooler.

However, this is an inherently unsanitary system. Often the filling of the coolers takes place utilizing water sources and hoses used for multiple other uses including washing equipment and filling chemical tanks. The typical filling method exposes the water to environmental contaminates in an open-air environment. For example, the coolers are open top containers with a lid that is placed on top of the container after filling. Moreover, if any surface of the cooler or spigot becomes contaminated and is not thoroughly cleaned the water being dispensed will come in contact with the contaminated surface.

Accordingly, there is a need for a safe system to fill and dispense water in such remote point-of-use locations.

SUMMARY

One aspect of the present system includes a sanitary bag having an outlet tube, the bag adapted to be sanitarily filled with water. The system further includes an insulated container to hold the bag, the container including a spigot, wherein the outlet tube of the bag extends through the spigot.

One aspect includes a system including a bag having an outlet and a water input member having a first end in communication with a sanitary water supply and a second end removably attachable to an input portion of the bag, the second end attachable to and removable from the input portion of the bag in a substantially sealed configuration such that the bag can be filled with water such that the water is not exposed to contaminants upon removal of the second end from the input portion.

One aspect includes a method comprising attaching an input member from a sanitary water supply to an inlet of a sanitary bag in a substantially sealed configuration, filling the flexible bag with water, removing the input member from the inlet without allowing any contaminants to reach the water, and placing the flexible bag within a portable insulated container for use at a location remote from the filling location.

DETAILED DESCRIPTION

The following detailed description and accompanying drawings show specific embodiments in which the present invention may be practiced. These embodiments are described in sufficient detail to enable those skilled in the art to practice the invention. Other embodiments may be utilized and structural changes may be made without departing from the scope of the present invention.

In one embodiment of the inventive subject matter disclosed herein, the present system can be used for the on-site filling and distributing of safe and sanitary drinking water on golf courses and other facilities that provide drinking water for patrons such as theme parks, sporting events, fairs, etc. The system design easily adapts to current coolers, cooler stands and procedures for filling and handling.

The system provides for an end-user to fill and dispense drinking water in which all surfaces that the water contacts are disposable. The result is a self-contained, end-user operated system for filling and dispensing sanitary drinking water. As used herein, an end-user is the person and his agents who fill the bag and provide the water on-site, at a golf course or park, for example. Thus, it includes a golf course maintenance manager and all of his co-workers and employees, for example.

Figure 1:
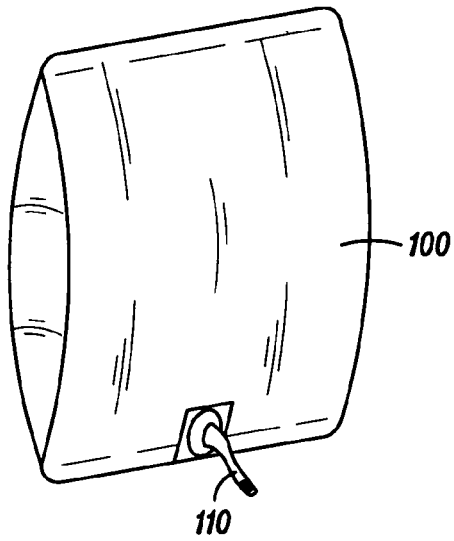
FIG. 1 shows a bag for dispensing water according to one embodiment of the inventive subject matter disclosed herein.
Figure 2:
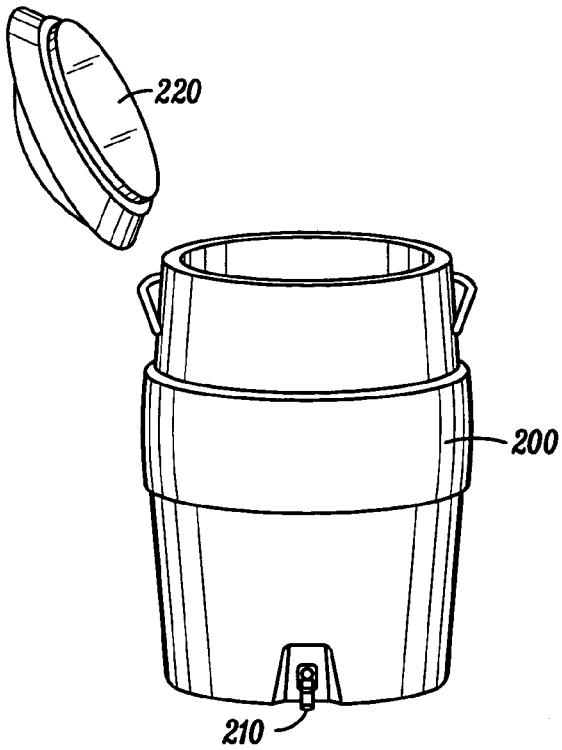
FIG. 2 shows a container for holding the bag of FIG. 1.

FIGS. 1 and 2 show a flexible bag 100 and container 200 in accordance with one embodiment of the present system. In one embodiment, flexible bag 100 is a sanitary, disposable, plastic bag formed of a food-grade material. For example, bag 100 can be made from the material used presently to supply milk. Flexible bag 100 is adapted according to the present system to be sanitarily filled with water by an end-user of the bag. Bag 100 includes an outlet tube 110 located on a lower surface of the bag such that the water is gravity-fed out of the bag.

In one example use of the present system, a plurality of sanitary bags, such as bag 100 can be distributed to a golf course, a park, or other location where the bags can be filled on-site and where the water is dispensed on-site in a location which is remote from the filling location. Bags 100 can be distributed as sanitary, empty, sealed bags which are adapted to be filled sanitarily on-site by the end-user of the bag.

Bag 100 fits within container 200 so that the sanitarily filled bag can be dispensed at a location remote from its filling location. For example, a plurality of containers 200 can be positioned at various holes of a golf course. In one embodiment, container 200 is an insulated container including a spigot 210 and a cover 220. Examples of such insulated containers are 5 or 10 gallon jug coolers made by Igloo or Rubbermaid.

Bag 100 is positioned within container 200 such that outlet tube 110 extends through spigot 210. Spigot 210 pinches the tube shut until a user actuates the spigot, thus releasing water from the bag. In use, water delivered from bag 100 never touches spigot 210. In contrast, the water is dispensed directly from tube 110.

As will be discussed below, bag 100 is fillable sanitarily by an end-user, such as a golf course maintenance worker through a water input member on the bag, such as outlet tube 110. This allows water to be sanitarily filled and dispensed by an end-user on site without having to buy pre-filled bottled water. Moreover, bag 100 is non-refillable since, as will be detailed below, the outlet tube 110 is cut after being filled.

Figure 3:
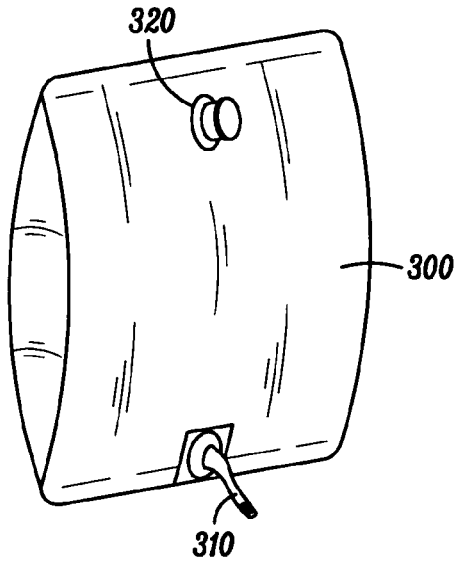
FIG. 3 shows a bag for dispensing water according to one embodiment of the inventive subject matter disclosed herein.

FIG. 3 shows a flexible bag 320 according to one embodiment. Flexible bag 320 is similar to bag 100 except the water input member of bag 300 is a separate one-time-use filling valve 320. As discussed above, bag 300 can be sanitarily filled by an end-user and then dispensed by using container 200.

Figure 4:
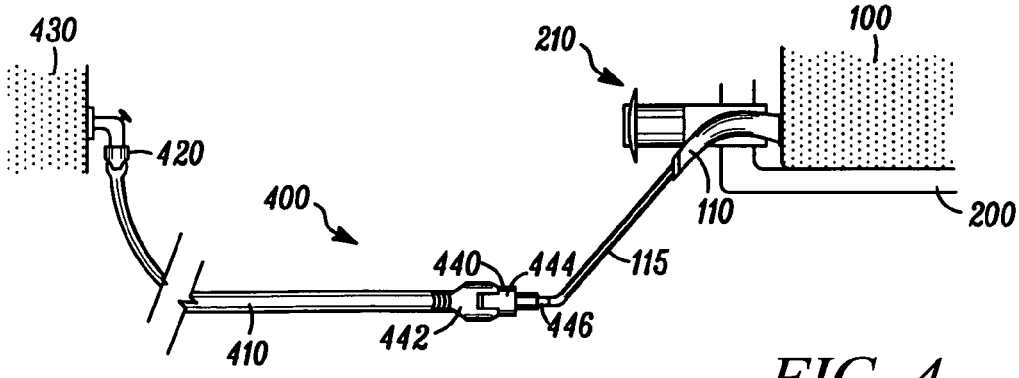
FIG. 4 shows a filling system according to one embodiment.

FIG. 4 shows a filling system 400 for filling flexible bag 100, in accordance with one embodiment. In one example, filling system 400 includes a water input member 410, such as a flexible, food-grade, sanitary hose, having a first end 420 in communication with a sanitary water supply 430 and a second end 440 removably attachable to an input portion 115 of flexible bag 100. In this embodiment, the input portion 115 of bag 100 is outlet tube 110. In one embodiment, second end 440 is attachable to the input portion 115 in a substantially sealed configuration and removable therefrom such that the water delivered to the flexible bag is not exposed to outside air or contamination upon removal of the second end from the input portion.

For example, second end 440 can include a constant pressure fill coupler 442 connected to a one-way fill nozzle 444 to prevent backflow. Fill nozzle 444 can include a barbed nozzle tip 446 to engage the inner surface of tube 110 in a sealed, interference fit. To fill the bag, an user first places an empty bag 100 into container 200 and threads outlet tube 110 though the outlet of spigot 210. The outlet tube typically includes a plugged portion at the distal end of the tube. The plugged portion is cut off and nozzle tip 446 is inserted into the tube. The water supply is actuated and the bag is filled through outlet tube 110 via input member 410. After the bag is filled, spigot 210 is closed, pinching outlet tube 110. Then the outlet tube is cut again close to where it exits spigot 210. The container 200 can then be brought to a remote location for dispensing. This system ensures that the end-user cannot re-use the bag since there is no easy way to re-fill the bag once the outlet tube 110 has been cut so short. This system of deforming the input port of the bag provides for an inherently sanitary, safe system.

Input member 410 allows the end user to fill the bag with nozzle 444 attachable to and removable from the input portion 115 of the bag in a substantially sealed configuration such that the end-user of the bag can fill the bag with water such that the water is not exposed to outside air or contaminants upon removal of second end 440 from the input portion 115.

Figure 5A:
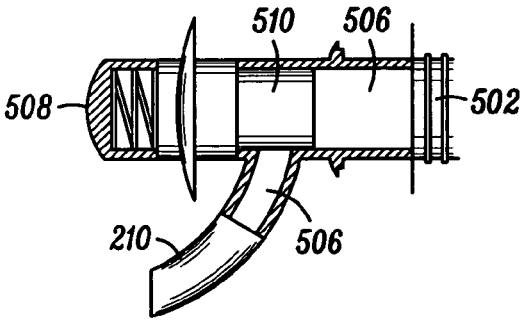
FIGS. 5A and 5B show a spigot for a water dispensing system according to one embodiment.
Figure 5B:
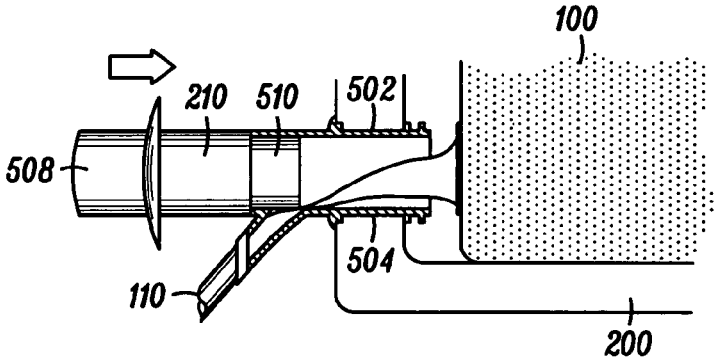

FIGS. 5A and 5B show details of spigot 210 according to one embodiment. Spigot 210 includes a first end 502 that is adapted to fit within the outlet 504 of existing coolers, such as discussed above. Spigot 210 includes a channel or chamber 506 for the outlet tube 110 to extend through. A spring-loaded pinch valve 508 includes a plug 510 which pinches the tube when the user lets go of the valve since the valve is biased, via the spring, towards the water bag.

Figure 6:
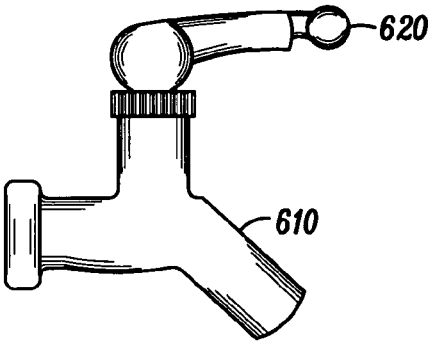
FIG. 6 shows a spigot for a water dispensing system according to one embodiment.

FIG. 6 shows a spigot 610, in accordance with one embodiment. Spigot 610 can be used in any of the embodiments discussed herein. Spigot 610 is similar to the spigots found on coffee urns. Spigot 610 works similar to spigot 210 except the actuator 620 of spigot 610 includes a detent position when the actuator is pushed up to a vertical position. This allows for easier filling of bag 100 since the user doesn't have to hold the actuator open when trying to fill the bag.

Figure 7:
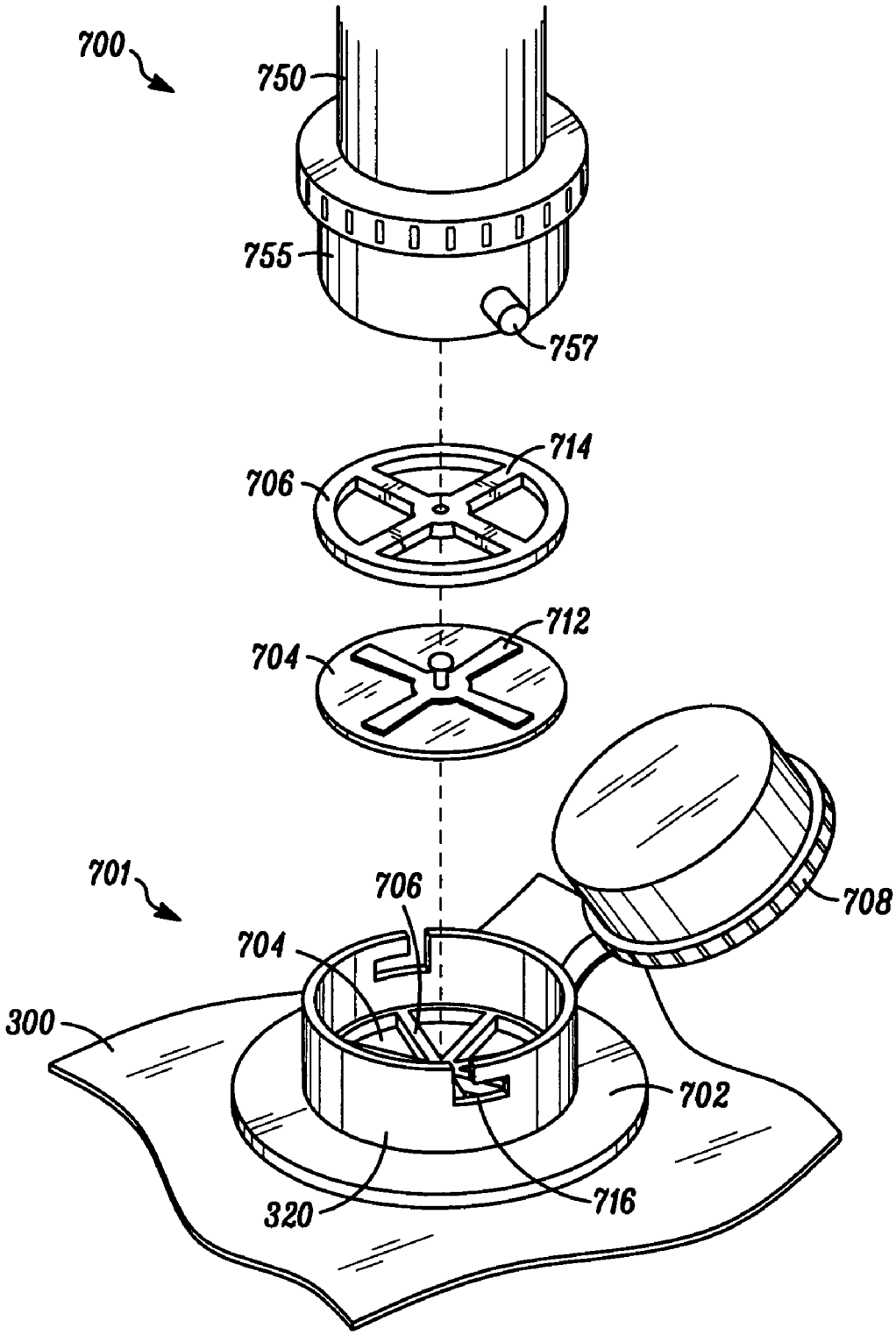
FIG. 7 shows a valve for filling a water bag in accordance with one embodiment.

FIG. 7 shows a filling system 700 according to one embodiment. System 700 is for filling a bag having a valve 320 as shown above in FIG. 3. Filling system 700 includes an input member 750 having a first end in communication with a sanitary water supply and a second end 755 which is removably attachable to an input portion 701 of flexible bag 300. In this embodiment, the input portion 701 of bag 300 is valve 320.

Valve 320 includes a bottom portion 702 attached to bag 300. Located within bottom portion 702 is a rubber valve 704 attached to a vent portion 706. In one example, vent portion 706 and bottom portion 702 can be a single piece. A cap 708 covers the valve. Rubber valve includes cutouts 712 aligned along the ribs 714 of vent portion 706.

In use, second end 755 is attached to valve 320 such that an arm 757 on the second end engages a notch 716 in valve 320. The cut-outs 712 in the rubber valve fold inward allowing water to flow in and then seal back up again when the water is turned off. After filling the bag, the cap 708 can be re-attached.

Figure 8A:
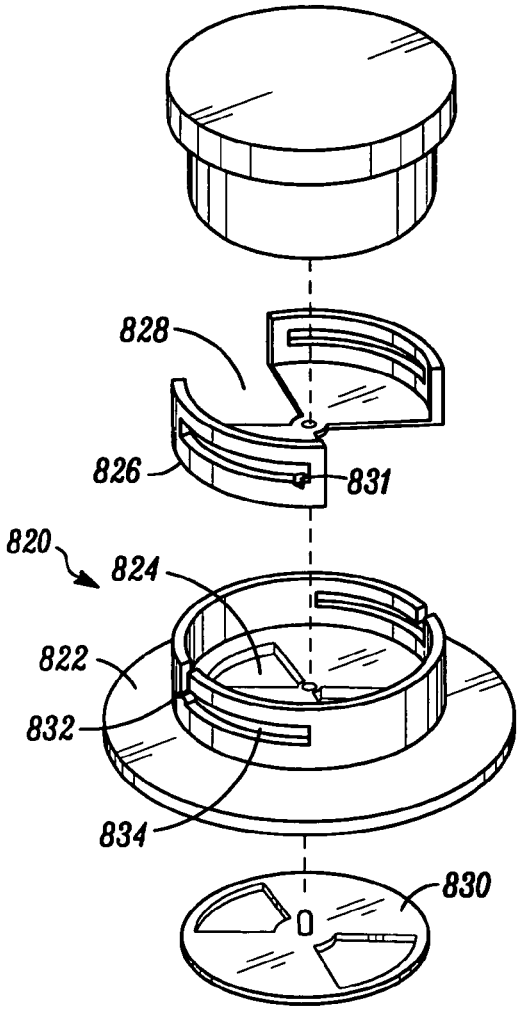
FIGS. 8A and 8B show a valve for filling a water bag in accordance with one embodiment.
Figure 8B:
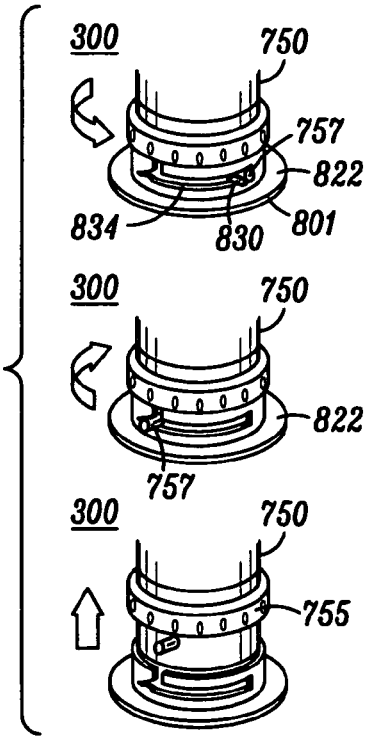

FIGS. 8A and 8B show a system 800 for filling a water bag 300 having a valve 820 according to one embodiment. Valve 820 can be substituted for valve 320 for the bag of FIG. 3, and the above discussion is incorporated herein. System 800 includes input member 750 having a first end in communication with a sanitary water supply and a second end 755 which is removably attachable to an input portion 801 of flexible bag 300. In this embodiment, the input portion 801 of bag 300 is valve 820.

Valve 820 includes a bottom portion 822 attached to bag 300. Bottom portion 822 includes one or more holes 824. Valve 820 further includes a top rotatable portion 826 having one or more cut-outs 828. In use, rotatable portion 826 can be rotated to a closed position wherein the cut-out 828 is not positioned over the hole 824 and can be rotated to an open position wherein the cut-out is positioned over the hole. Some embodiments include a rubber valve 830 attached below bottom portion 822 and having slits aligned along the holes of the bottom portion.

In one embodiment, rotatable portion 826 includes an engaging member 831 and bottom portion 822 includes a tight notch 832 within larger notch 834. Referring to FIG. 8B, in use, input member 750 is engaged with valve 820 such that arm 757 rotates to the end of notch 834 and goes over the top of engaging member 831. After water is filled into the bag, input member 750 is rotated and arm 757 pushes engaging member 831 into tight notch 832 where the engaging member is locked in place. This results in the bag being non-refillable since the rotatable member cannot be rotated again into an open position. Again, this deformation of the input port of the bag provides for a one-time use of the bag to provide an inherently sanitary system.

Figure 9:
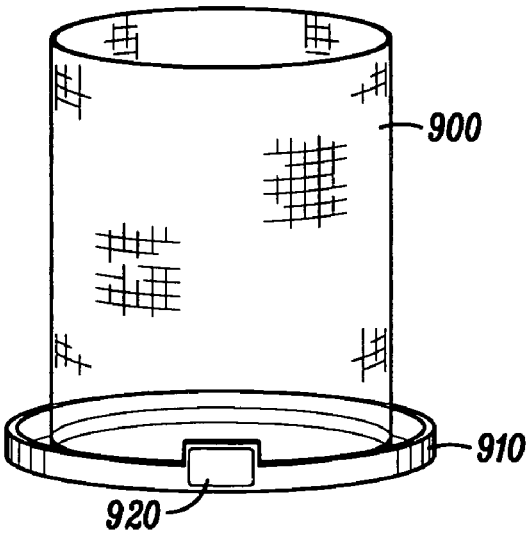
FIGS. 9 and 10 show a liner for use in a water dispensing system in accordance with one embodiment.
Figure 10:
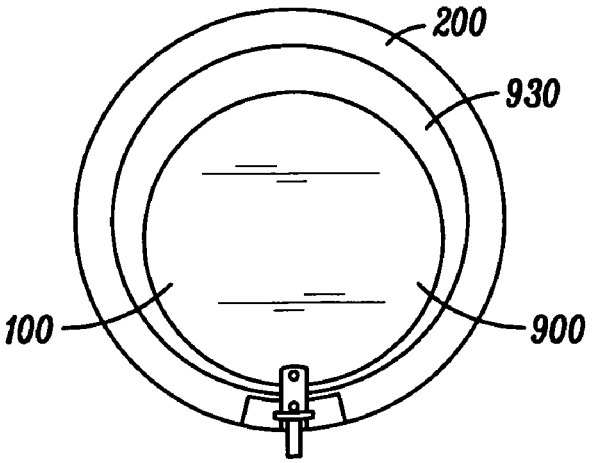

FIGS. 9 and 10 show a liner 900 according to one embodiment. Liner 900 is for use within container 200 if desired to hold bag 100 (or 300). Liner 900 includes a generally cylindrical body and can be formed of a mesh material, for example. In one embodiment, liner 900 is attached to a ring 910 which is dimensioned to fit within container 200. Liner is attached to ring 910 in an off-set manner so that an outlet opening 920 on the liner can be positioned flush with the spigot of container 200. Liner 900 allows for ice 930 to be placed in container 200 to keep water bag 100 cold.

Figure 11:
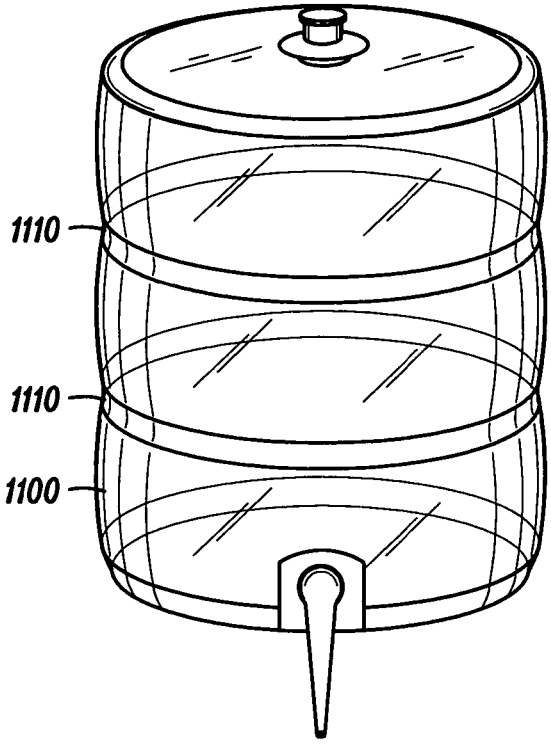
FIG. 11 shows a bag for dispensing water according to one embodiment.

FIG. 11 shows a water bag 1100 according to one embodiment. In this example, water bag 1100 includes one or more rings 1110 either built into the bag or removably attached to the bag. Rings 1110 hold a freezable gel allowing the rings to be frozen to keep the water cold.

Figure 12:
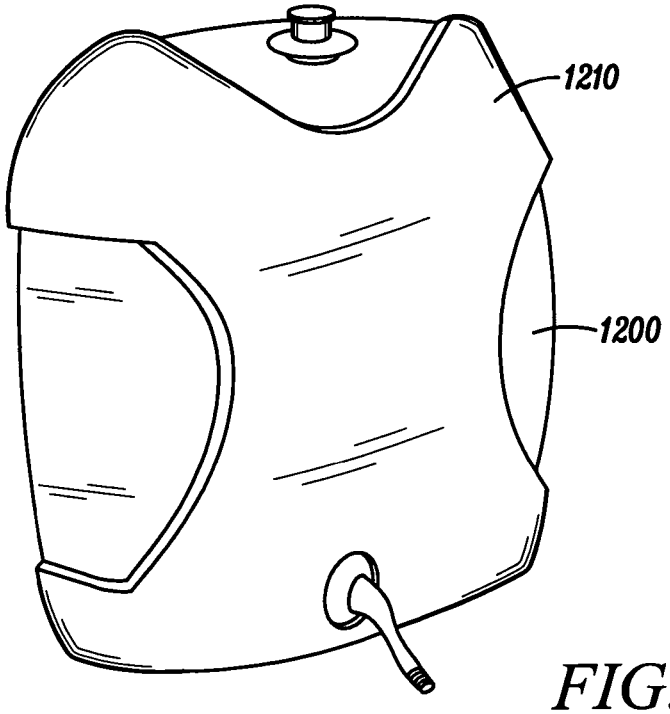
FIG. 12 shows a bag for dispensing water according to one embodiment.

FIG. 12 shows a water bag 1200 according to one embodiment. In this example, water bag 1200 includes a reusable vest 1210. Vest 1210 wraps around bag 1200 (or bag 100 or bag 300) and expands with the liner as the liner is filled with water. Vest 1210 can be filled with refreezable gel to provide cooling without ice.

In one example, to fill and provide sanitary water with the present system, an end-user positions an empty, sanitary, sealed, food-grade bag inside a portable container and threads the outlet tube of the bag through a spigot on the container. The end-user then attaches an input member from a sanitary water supply to a water inlet port of the flexible bag in a substantially sealed configuration. The bag is filled with water. The end-user then removes the input member from the inlet of the bag without allowing any outside air or contaminants to reach the water. The end-user then disposes the container at a location remote from the filling location. A person taking a drink of water from the container uses a disposable cup to receive water from the bag, with the water delivered without touching any surface of the container or spigot.

The present system addresses the previously described risk factors by minimizing or eliminating all environmental and human contact with the water. The system provides an avenue for filling, transporting and dispensing sanitary water on site utilizing an available water source and one-time use, disposable bags. For example, the system can utilize a single-use fill method either through a one time use valve or through an inlet/outlet tube which is cut off after filling and utilized to dispense the water. The system differs from conventional commercial bulk water products as the disposable bags are distributed to a site as empty, sealed bags which are then filled on-site on an as-needed basis rather than being provided by outside vendors. The system also provides an advantage over delivered products that utilize re-usable stands on which the water comes in contact with a re-usable spigot that unless sanitized daily becomes contaminated.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A system comprising:

a sanitary bag having an outlet tube, the bag adapted to be filled a single time with water at an on-site location;

an insulated container to hold the bag in a different on-site location which is remote from the on-site water-filling location, the container including a spigot, wherein the outlet tube of the bag extends through the spigot; and a water input member having a first end in communication with a sanitary water supply and a second end removably attachable to an input portion of the bag, the second end attachable to the input portion in a substantially sealed configuration and removable therefrom such that the water delivered to the bag is not exposed to outside air upon removal of the second end from the input portion, wherein the outlet tube of the bag is the input portion of the bag, wherein the water input portion of the bag is adapted to be deformed after an end-user has filled the bag with water such that the input portion cannot be re-used.

2. A system comprising:

a sanitary bag having an outlet tube, the bag adapted to be filled a single time with water at an on-site location;

an insulated container to hold the bag in a different on-site location which is remote from the on-site water-filling location, the container including a spigot, wherein the outlet tube of the bag extends through the spigot;

a water input member having a first end in communication with a sanitary water supply and a second end removably attachable to an input portion of the bag, the second end attachable to the input portion in a substantially sealed configuration and removable therefrom such that the water delivered to the bag is not exposed to outside air upon removal of the second end from the input portion, wherein the outlet tube of the bag is the input portion of the bag; and a liner within the insulated container and positioned around the bag.

3. A system comprising:

a sanitary bag having an outlet tube, the bag adapted to be filled a single time with water at an on-site location;

an insulated container to hold the bag in a different on-site location which is remote from the on-site water-filling location, the container including a spigot, wherein the outlet tube of the bag extends through the spigot; and a liner within the insulated container and positioned around the bag, wherein the liner is attached to a ring having approximately the same diameter as an interior of the insulated container, wherein the liner is attached to the ring in an offset manner.

4. The system of claim 1, wherein the spigot includes a plug which is biased so as to pinch the outlet tube closed.

5. The system of claim 1, wherein the outlet tube of the bag includes a flexible tube extending from a lower surface of the bag.

6. A system comprising:

a sanitary bag having an outlet tube, the bag adapted to be filled a single time with water at an on-site location;

an insulated container to hold the bag in a different on-site location which is remote from the on-site water-filling location, the container including a spigot, wherein the outlet tube of the bag extends through the spigot; and a water input member having a first end in communication with a sanitary water supply and a second end removably attachable to an input portion of the bag, the second end attachable to the input portion in a substantially sealed configuration and removable therefrom such that the water delivered to the bag is not exposed to outside air upon removal of the second end from the input portion, wherein the input member of the bag includes a valve on a surface of the bag.

7. A system comprising:

a sanitary bag having a dispensing outlet; and a water input member having a first end in communication with a sanitary water supply and a second end removably attachable to an input portion of the bag, the second end attachable to and removable from the input portion of the bag in a substantially sealed configuration such that the bag can be filled with water such that the water is not exposed to contaminants upon removal of the second end from the input portion, wherein the input portion of the bag is adapted to prevent reuse of the input portion after the water input member has been detached from the input portion;

wherein the input member of the bag includes a valve on a surface of the bag, wherein the valve includes a bottom portion attached to the bag and having a hole and a top rotatable portion having a cut-out, wherein the top, rotatable portion can be rotated to a closed position wherein the cut-out is not positioned over the hole and can be rotated to an open position wherein the cut-out is positioned over the hole.

8. The system of claim 7, wherein the second end of the water input member includes a portion to engage a corresponding portion of the top, rotatable member to rotate the top, rotatable member to the closed position as the second end of the water input member is removed from the valve.

9. A method comprising:

an end-user attaching an input member from a sanitary water supply to a water inlet of a food-grade bag in a substantially sealed configuration;

the end-user filling the bag with water via the input member;

the end-user removing the input member from the water inlet without allowing any outside air to reach the water; and the end-user placing the bag within a portable insulated container for use at a location remote from the filling location, wherein the bag is placed within the portable insulated container before filling the bag with water.

10. The method of claim 9, further including deforming the water inlet after the bag has been filled with water.

11. The method of claim 9, wherein attaching an input member includes attaching a nozzle of the input member to an outlet tube of the bag.

12. A method comprising:

an end-user attaching an input member from a sanitary water supply to a water inlet of a food-grade bag in a substantially sealed configuration;

the end-user filling the bag with water via the input member;

the end-user removing the input member from the water inlet without allowing any outside air to reach the water; and the end-user placing the bag within a portable insulated container for use at a location remote from the filling location, wherein attaching an input member includes attaching the input member to a valve on an outer surface of the bag.

13. A system comprising:

a sanitary bag having an outlet tube;

an insulated container to hold the bag, the container including a spigot, wherein the outlet tube of the bag extends through the spigot; and a water input member having a first end in communication with a sanitary water supply and a second end removably attachable to an input portion of the bag, the second end attachable to the input portion in a substantially sealed configuration and removable therefrom, wherein the outlet tube of the bag is the input portion of the bag, wherein the water input portion of the bag is adapted to be deformed after an end-user has filled the bag with water such that the input portion cannot be re-used.

14. The system of claim 13, wherein the sanitary bag and the water input member are configured such that the sanitary bag is fillable with water by an end-user of the bag at an on-site location.

* * * * *